US007260966B2

(12) United States Patent
Shimoda et al.

(10) Patent No.: US 7,260,966 B2
(45) Date of Patent: Aug. 28, 2007

(54) TUBE SHELL FOR MANUFACTURING A SEAMLESS STEEL PIPE AND A METHOD FOR ITS MANUFACTURE

(75) Inventors: Kazuhiro Shimoda, Nishinomiya (JP); Tomio Yamakawa, Kawanishi (JP); Hiroyuki Semba, Sanda (JP); Hirofumi Hori, Kainan (JP); Tsuneo Kondo, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/312,934

(22) Filed: Dec. 21, 2005

(65) Prior Publication Data

US 2006/0283225 A1 Dec. 21, 2006

Related U.S. Application Data

(63) Continuation of application No. PCT/JP04/09078, filed on Jun. 22, 2004.

(30) Foreign Application Priority Data

Jun. 23, 2003 (JP) ..... 2003-177742

(51) Int. Cl.
*B21B 19/04* (2006.01)

(52) U.S. Cl. ..... 72/97; 72/700; 148/325

(58) Field of Classification Search ..... 72/96, 72/97, 370.01, 370.14, 700; 148/325, 336
See application file for complete search history.

(56) References Cited

U.S. PATENT DOCUMENTS 2,536,033 A * 1/1951 Clarke, Jr. ..... 420/38
5,636,542 A * 6/1997 Yamakawa et al. ..... 72/97
5,713,234 A * 2/1998 Yamakawa et al. ..... 72/97
6,051,081 A * 4/2000 Valle Echevarria et al. 148/325

FOREIGN PATENT DOCUMENTS

| | | |
|---|---|---|
| DE | 19516595 | 11/1996 |
| JP | 60-114554 | 6/1985 |
| JP | 63-299805 | 12/1988 |
| JP | 01228603 | 9/1989 |
| JP | 2000-301212 | 10/2000 |
| JP | 2001-049400 | 2/2001 |
| JP | 2001-162306 | 6/2001 |

* cited by examiner

*Primary Examiner*—Ed Tolan
(74) *Attorney, Agent, or Firm*—Clark & Brody

(57) ABSTRACT

A pierced shell of an austenitic stainless steel having a good inner surface condition is provided, and a means is established which can perform mass production on an industrial scale of a good quality seamless steel pipe of stainless steel. An austenitic stainless steel billet with a P content of at most 0.040% and an S content of at most 0.020% is pierced under conditions such that the pipe expansion ratio H (outer diameter of shell/diameter of billet to be worked) satisfies the following equation to obtain a tube shell of an austenitic stainless steel. $\{P(\%)/(0.025\times H-0.01)\}^2+\{S(\%)/(0.015\times H-0.01)\}^2 \leqq 1$. When manufacturing a seamless steel pipe of an austenitic stainless steel, the above-described shell is rolled to form a pipe.

25 Claims, 3 Drawing Sheets

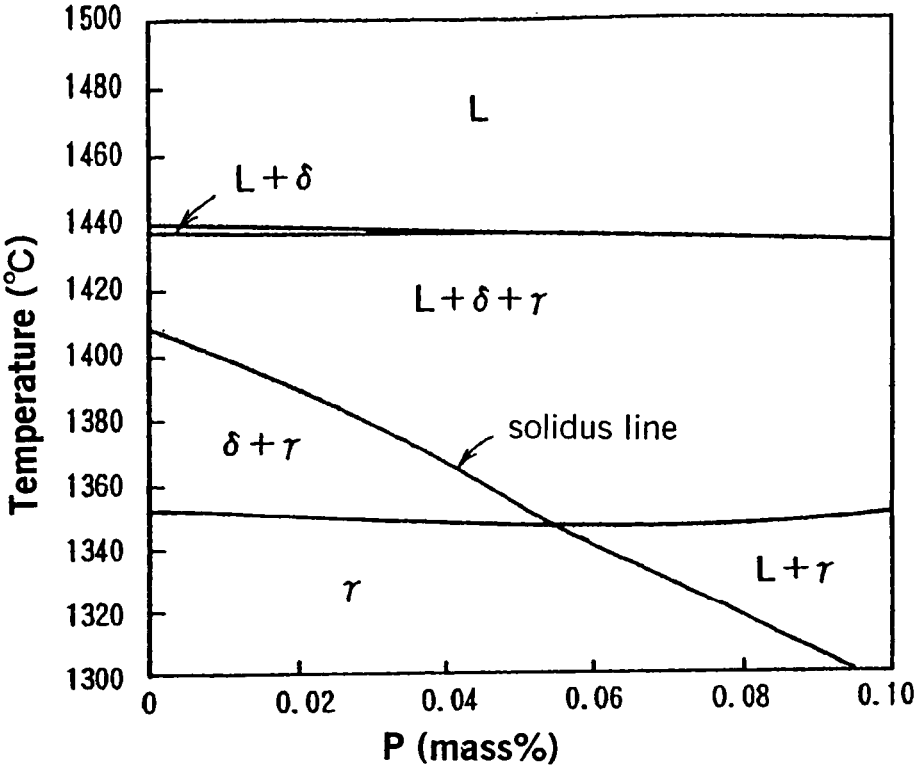
Fig. 1
Fig. 2(a)
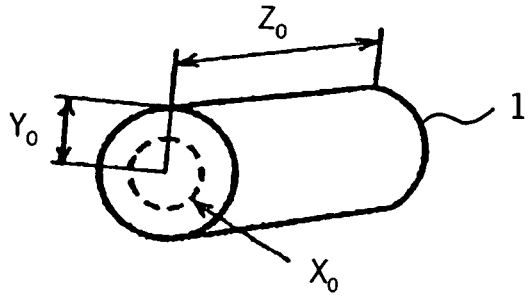
Fig. 2(b)
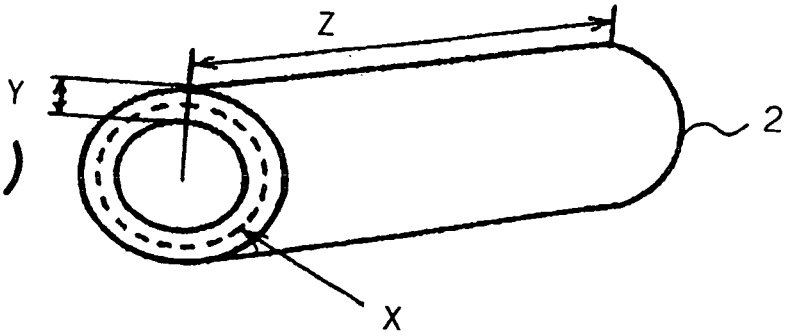

TUBE SHELL FOR MANUFACTURING A SEAMLESS STEEL PIPE AND A METHOD FOR ITS MANUFACTURE

This application is a continuation of International Patent Application No. PCT/JP2004/009078, filed Jun. 2004. This PCT application was not in English as published under PCT Article 21(2).

TECHNICAL FIELD OF THE INVENTION

This invention relates to a tube shell for manufacturing a seamless steel pipe made from an austenitic stainless steel and a method for its manufacture, and a method of manufacturing a seamless steel pipe made of an austenitic stainless steel which employs the shell or its manufacture method.

BACKGROUND ART

At present, a representative example of a method of manufacturing a seamless steel pipe (referred to below as pipe manufacture) is a method in which piercing with skewed rolls (referred to below as piercing) is performed on a billet using a piercer (a piercer with skewed rolls) to obtain a hollow tube shell (referred to below as a shell). The shell is rolled and elongated by a rolling mill such as an elongator, a plug mill, or a mandrel mill, and then finally it is sized by a sizer or a stretch reducer.

In this case, if the material for forming the seamless steel pipe is an ordinary low carbon steel having a relatively low content of alloying components, it is relatively easy to obtain a good quality shell using a piercer, which is advantageous from the standpoint of mass production. However, when using a high alloy steel such as SUS316, SUS321, or SUS347 specified by JIS or other austenitic stainless steel as a material to be worked, since these materials are difficult to work materials, if a piercer is employed, inner surface flaws caused by Mannesmann breakdown which is characteristic of piercing can easily form in the shell, and if inner surface flaws form, there are cases in which it becomes impossible to obtain a good quality seamless steel pipe.

There has yet to be reported a suitable measure for preventing the formation of inner surface cracks which can be applied to actual production lines. Therefore, it has been thought difficult to carry out mass production on an industrial scale of seamless steel pipe of a high alloy steel such as an austenitic stainless steel.

In addition to the above, in the case of an austenitic stainless steel, inner surface flaws caused by grain boundary melting can easily occur. Grain boundary melting is a phenomenon in which low melting point substances present at grain boundaries melt due to the heat generated by working in a piercer with skewed rolls. If grain boundary melting occurs, the ductility of the material abruptly decreases, and this leads to breakage, i.e., cracks at the time of piercing of the shell.

The above-described grain boundary melting occurs in the body of a material including the inner surface thereof where the temperature of the material becomes highest during piercing. Flaws which propagate from there as a starting point are almost impossible to repair, and so this unavoidably leads to a marked decrease in yield.

With austenitic stainless steel and particularly austenitic stainless steels such as SUS316, SUS321, and SUS347 which contain alloying elements such as Mo, Ti, Nb, and Cu, these alloying elements easily form low melting point substances, so grain boundary melting occurs particularly readily. In addition, if these alloying elements are added, the strength of the material increases, and the heat generated by working during piercing increases, and this becomes a cause of promoting the occurrence of grain boundary melting.

In order to prevent this grain boundary melting, it is thought that piercing which suppresses the heat generated by working with a piercer is effective.

In order to carry out piercing while suppressing the heat generated by working, normally, a method is employed in which the rotational speed of skewed rolls is decreased and the strain rate of the material is decreased, or a method in which the wall thickness of the pierced material is increased.

However, if the rotational speed of the rolls is decreased, time is required for piercing with the piercer, and not only is the lifespan of tools (particularly a plug) greatly decreased, but the temperature of the resulting shell decreases, so a method in which the rotational speed of the rolls is decreased, i.e., a method in which the speed of piercing is decreased cannot be applied to an actual production line.

If the wall thickness of the material being pierced is increased, rolling performed in a pipe rolling mill (such as an elongator, a plug mill, or a mandrel mill) disposed downstream of the piercer becomes unstable, and the manufacturing yield of seamless steel pipes enormously decreases, so this method, too, can not be applied to an actual production line.

In order to stabilize rolling in a pipe rolling mill disposed downstream of a piercer, it is desirable to supply the rolling mill with a thin-walled material which is at as high a temperature as possible, i.e., a thin-walled shell at a high temperature. However, if the heating temperature of a billet to be worked is increased in order to supply a high temperature shell, the material reaches a temperature at which grain boundary melting occurs with even a slight amount of heat generated by working, so it was all the more difficult to carry out piercing to form a thin wall thickness which requires a large degree of working under conditions in which the heating temperature of a billet is increased in this manner.

In Japanese Published Unexamined Patent Application 2000-301212, as a method for piercing a difficult to work metal, a piercing method in which the heating temperature of a billet and the speed of piercing by a piercer are adjusted in conjunction with each other, and as a result the temperature of the billet is maintained at lower than an overheating temperature (1260-1310° C.), and piercing is performed is disclosed. Here, the overheating temperature is a temperature which brings about grain boundary melting of the material. The grain boundary melting temperature for a austenitic stainless steel such as SUS316, SUS321, and SUS347 is in the range of 1260-1310° C.

However, the method disclosed in Japanese Published Unexamined Patent Application 2000-301212 merely controls the value of a formula using the piercing speed and billet heating temperature as variables to less than the overheating temperature and thereby aims at preventing the billet temperature during piercing from being greater than or equal to the overheating temperature. From the examples thereof, specifically, it can be seen that in order to obtain a shell without flaws, it is necessary to heat the billet to a low temperature of 1100-1180° C.

In addition, in the examples of the above-mentioned publication, the piercing speed is at most 300 mm/second, so when obtaining a shell with a length of 8 m, 30 seconds are required, which is not practical.

Furthermore, in the examples, a simulation of plasiticine is carried out. At that time, the ratio (the t/d ratio) of the wall thickness to the outer diameter of the shell after piercing is 15%, so the wall thickness is considerable.

Accordingly, with this method, stable rolling cannot be guaranteed in the subsequent rolling mill, and in addition, the lifespan of the piercer tool is not adequate.

In "CAMP-ISIJ", Volume 6 (1993), pages 370-373, an example is reported of piercing of SUS316L with a piercer in an actual production line. However, in that report, in order to prevent flaws on the inner surface of the pierced shell, it is necessary to decrease the peripheral speed of skewed rolls as well as to control the heating temperature of a billet to at most 1190° C. so there are problems like those of the method disclosed in the above-mentioned Japanese Published Unexamined Patent Application 2000-301212.

Japanese Published Unexamined Patent Application 2001-162306 discloses a method of preventing flaws on the inner surface of a pierced shell by controlling the value of a formula using the billet diameter, the diameter of skewed rolls, and the rotational speed of skewed rolls as variables. However, with this method as well, piercing is carried out while reducing the rotational roll speed of skewed rolls, and it is essentially no more than a means of limiting the piercing speed, i.e., the strain rate of the material, and it has problems such as an increase in the time required for piercing, a decrease in tool lifespan, and a decrease in the temperature of a shell, so it cannot be said to be a means which can be applied to an actual production line.

DISCLOSURE OF THE INVENTION

According to the present invention, a good quality shell is provided which can be used to stably manufacture a seamless steel pipe of an austenitic stainless steel having a good condition of its inner surface. In addition, a method is provided which can stably manufacture such a shell in an actual production line under conditions which are fully applicable.

In addition, according to the present invention, a seamless steel pipe of an austenitic stainless steel using such a shell is provided, and a manufacturing method which can obtain mass production on an industrial scale of such a stainless steel pipe is provided.

In order to stably manufacture a thin-walled seamless steel pipe of an austenitic stainless steel, the present inventors hit upon the idea of using a shell like one of an ordinary carbon steel. For this purpose, with an austenitic stainless steel, it is preferable for the heating temperature of a billet to be worked to be at least 1200° C. and for the shell after piercing to have a ratio (the t/d ratio) of the shell wall thickness t to its outer diameter d of at most 7%. However, with an austenitic stainless steel, with existing piercing technology, it was not possible to obtain such a shell without causing grain boundary melting.

The present inventors performed investigations from various angles to achieve the above object, and based on past experiences as well, they reached the following conclusions.

Namely, as stated above, in order to stably manufacture a seamless steel pipe of an austenitic stainless steel on an actual production line, it is necessary to supply a pierced shell having as thin a wall thickness as possible, i.e., a shell having a wall thickness of about the same level as when manufacturing a steel pipe of carbon steel at a high temperature and to stably perform rolling in rolling mills downstream of the piercer.

According to the experience of the present inventors, even with an austenitic stainless steel, in order to decrease the load on a rolling mill downstream of a piercer and to make it possible to prevent misrolling and as a result to stabilize the manufacture of seamless steel pipe of an austenitic stainless steel, it is necessary for the ratio t/d of the shell after piercing (after skewed rolling) to be at most 7% and for the heating temperature of a billet to be at least 1200° C.

However, according to supplemental tests performed by the present inventors, when the t/d ratio of a shell to be obtained using a piercer is at most 7%, the occurrence of grain boundary melting is unavoidable even if limitations are imposed on the roll rotational speed and the billet heating temperature.

Therefore, as a result of continued research for finding a technique of obtaining a good quality pierced shell having a t/d ratio after piercing of at most 7% by performing piercing under conditions in which an austenitic stainless steel billet is heated to at least 1200° C. and special limitations are not imposed on the rotational speed of the rolls, the following knowledge was obtained.

The present inventors perceived that the main cause of grain boundary melting which becomes a large problem in piercing of an austenitic stainless steel is elements in the steel which form low melting point substances. They investigated the extent to which each of the components making up an austenitic stainless steel has an effect on grain boundary melting.

Up to the present time, there have been few reports on limiting the components of the billet in the Mannesmann pipe forming method to limit grain boundary melting. The reason for this is thought to be that compared to other pipe forming methods (such as the extrusion method), in piercing using a piercer, the amount of heat generated by working is extremely large, and therefore it was thought that it was not possible to suppress grain boundary melting just by improving the components of the material.

In an investigation of the degree of effect that the constituent components of a steel have on grain boundary melting, first, the effect of each constituent element on the solidus temperature (melting point) of an austenitic stainless steel was studied using a simulated phase diagram.

As a result, it was determined that reducing the amount of metallic elements such as Mo, Ti, Nb, and Cu which form low melting point compounds is most effective at increasing the grain boundary melting temperature, but there was the problem that due to reasons such as designation of components is made by customers and manufactures, these elements cannot be adjusted freely by manufactures.

By means of tests based on the results of the above-described investigations, the present inventors found that among the elements which can be adjusted without deviating from prescribed component specifications, P and S in particular have an extremely large effect on grain boundary melting, and that if the content of P and S is decreased, nearly the same effect on increasing the grain boundary melting temperature is obtained as when lowering each metal element (Mo, Ti, Nb, Cu, and the like).

For example, FIG. 1 is a phase diagram showing the influence of P on the solidus temperature, i.e., the melting point of SUS316 which is an austenitic stainless steel. It can be seen that the solidus temperature abruptly increases as the P content decreases. In the figure, γ and δ indicate the respective solid phases, and L indicates the liquid phase. JIS SUS316 has the composition shown in the below-described Table 1.

S shows the same tendency as does P.

The present inventors also discovered that another important factor in grain boundary melting which becomes a problem in piercing of an austenitic stainless steel is heat generated during working, and they performed research concerning the presence or absence of a countermeasure for decreasing the amount of heat generated by working under conditions which can be adequately applied to an actual production line.

The amount of heat Q produced by working is proportional to the plastic working W of a material and is expressed by the following Equation 1.

$$Q=C\times W \text{ (C is a constant)} \quad (1)$$

Accordingly, suppressing the amount of plastic working W decreases the amount of heat Q produced by working, and this in turn leads to a decrease in grain boundary melting.

Here, the amount of plastic working W is the value of the integral of the equivalent stress of the material with respect to the equivalent strain, as shown by the following Equation 2.

$$W=\int\bar{\sigma}d\bar{\epsilon} \quad (2)$$

wherein $\bar{\sigma}$: equivalent stress $\bar{\epsilon}$: equivalent strain

The equivalent stress is the resistance to deformation of the material, and it increases in accordance with the rate of strain. Therefore, by suppressing the equivalent stress shown in Equation 2, i.e., the resistance to deformation of the material and the equivalent strain, the amount of heat Q generated by working can be reduced.

In the prior art, the reason why the rotational speed of the rolls was decreased to avoid grain boundary melting was in order to decrease the peripheral speed of the rolls and suppress the resistance to deformation which is related to the amount of heat generated by working. In addition, in the prior art, the reason why piercing of a thick-walled member was unavoidable was because it was not possible to increase the equivalent strain while reducing the amount of heat generated by working.

The present inventors discovered that when obtaining shells with the same ratio of wall thickness to outer diameter, the equivalent strain can be decreased by increasing the ratio of the outer diameter of the shell after piercing to the billet diameter. They found that by combining this piercing technique with control of the content of P and S in the billet to be worked, it is possible to prevent grain boundary melting without imposing limitations on the roll rotational speed and the heating temperature of the billet to be worked. They also found that even when the object being manufactured is an austenitic stainless steel pipe with a t/d ratio of at most 7, it is possible to perform piercing without bringing about grain boundary melting.

Namely, if shear strain is ignored, the equivalent strain can be found by the following Equation 3 based on the Levy-Mises equations.

$$\bar{\epsilon}=[\{(\epsilon_x-\epsilon_y)^2+(\epsilon_y-\epsilon_z)^2+(\epsilon_z-\epsilon_x)^2\}\times 2]^{0.5}/3 \quad (3)$$

Here, $\epsilon_x$ is the strain in the circumferential direction of the pierced shell, $\epsilon_y$ is the strain in the radial direction of the pierced shell, and $\epsilon_z$ is the strain in the longitudinal direction of the pierced shell. They are found by the following Equation 4, Equation 5, and Equation 6, respectively.

$$\epsilon_x=\text{In}(x/x_0) \quad (4)$$

$$\epsilon_y=\text{In}(x/y_0) \quad (5)$$

$$\epsilon_z=\text{In}(x/z_0) \quad (6)$$

FIGS. 2(*a*) and 2(*b*) are schematic perspective views of a hollow billet 1 to be worked and a hollow shell 2 after piercing, respectively. They show the definitions of x, y, z and $x_0$, $y_0$, and $z_0$ in the above equations. The dashed lines in each figure indicate the center of the cross section and the center of the wall thickness of the end surface, respectively.

Here, $x_0$: radius of billet×π

$y_0$: radius of billet $z_0$: length of billet x: (outer diameter of shell+inner diameter of shell)×π/2 y: wall thickness of shell z: length of shell

From the law of conservation of volume, the following Equation 7 is established among $\epsilon_x$, $\epsilon_y$, and $\epsilon_z$.

$$\epsilon_x+\epsilon_y+\epsilon_z=0 \quad (7)$$

The present inventors realized that if instead of carrying out piercing by elongation in the longitudinal direction while restricting the outer diameter of a shell with a strong roll pressing force, piercing is carried out with a large ratio of the outer diameter of the shell to the billet diameter (the pipe expansion ratio), it should be possible to decrease the ratio t/d, and it should also be possible to achieve a relatively small equivalent strain, and using the above-described equations, they calculated the equivalent strain applied to a material when carrying out piercing by increasing the outer diameter of the shell without increasing the wall thickness, i.e., piercing of expanded pipe, instead of performing piercing by increasing the wall thickness of the shell and suppressing an increase in equivalent strain.

The results are shown in FIG. 3 by the curve with respect to the pipe expansion ratio and the equivalent strain applied to the material. It became clear from the results shown in FIG. 3 that the equivalent strain applied to a material for piercing decreases as the pipe expansion ratio increases.

In this manner, when t/d is constant, the reason why the equivalent strain decreases as the pipe expansion ratio increases can be explained as follows.

Namely, if the pipe expansion ratio is increased, a long billet with a small outer diameter becomes necessary. This is a premise for obtaining shells of the same dimensions and is necessary for maintaining the volume. Accordingly, when increasing the pipe expansion ratio and obtaining shells of the same dimensions, of the three components of strain, the circumferential component increases, but the components in the thickness direction and longitudinal direction both decrease. When the pipe expansion ratio is increased, whether the equivalent strain increases or decreases can be determined by calculations in the above manner.

Under conditions in which the equivalent strain is the same, the reason why t/d decreases as the pipe expansion ratio increases can be explained as follows.

Namely, as described above, the equivalent strain decreases by making a pierced hole in an expanded pipe. Accordingly, when the equivalent strain is the same, a pierced expanded pipe becomes a thin-walled shell with a larger degree of working, namely, it becomes a shell with a small t/d ratio.

In FIG. 3, the curves shown by the solid line and the dashed line are calculated values for a constant t/d ratio (the solid line is for a low fixed value of the t/d ratio, and the dashed line is for a high fixed value of the t/d ratio). As shown by the arrow in the figure, it can be seen that as the pipe expansion ratio increases, even when the equivalent strain level is of about the same level as when piercing is performed with a high t/d ratio with a conventional low pipe expansion ratio (and accordingly, the obtained shell stops at a large wall thickness) a thin-walled shell with a low t/d ratio is obtained.

Accordingly, from this result of calculation, by increasing the pipe expansion ratio, it was confirmed that while stably manufacturing a stainless steel pipe of austenitic stainless steel, a pierced shell (a thin-walled shell) having the necessary low t/d ratio is obtained.

According to the above-described result of calculation, if the ratio of the outer diameter of the shell after piercing to the diameter of the billet being worked (namely. the pipe expansion ratio) is increased, the generation of heat due to working is decreased, and the danger of grain boundary melting should be suppressed, but in the above-described formula used for calculation, all the physical phenomena which are connected with working, such as the friction and shearing deformation of the material and the tool, are not taken into consideration.

Therefore, the present inventors conducted further verification of the above theory by way of experiment.

In this experiment, an austenitic stainless steel billet of SUS316 steel which was heated to 1250° C. was pierced in a model mill to form a shell with a length of 3 m, then the shell was cut into rings at a pitch of 300 mm, and then each was split longitudinally as shown in FIG. 4, and the presence or absence of inner surface flaws caused by grain boundary melting was ascertained. When there were not only inner surface flaws but there were defects on the cut surface of the material, it was determined that there were inner surface flaws.

FIG. 4 is a schematic perspective view of a shell which was longitudinally slit in the above-described manner. It shows the form of inner surface flaws (inside scab) caused by grain boundary melting. In the figure, reference number 10 shows typical inner surface flaws, and reference number 12 shows defects seen on the cut surface.

Table 1 shows the piercing conditions in the model mill which was used as a test apparatus.

TABLE 1

| Piercing Conditions | |
|---|---|
| roll skew angle | 10° |
| gorge draft | 10–13% |
| draft at end of plug | 5–6% |

In Table 1, the gorge draft and the draft at the end of the plug are dimensionaless values indicating the position of the roll opening and the end of the plug as described, for example, in *Iron and Steel Handbook*, Volume 3, Chapter 2, "Rolling Equipment for Both Bar Steel and Steel Pipes", Third Edition, published by Maruzen Company, page 934, and they are calculated by the following Equation 8 and Equation 9.

$$\text{gorge draft (\%)}=(\text{billet diameter}-\text{roll opening in gorge portion})\times(\text{billet diameter})^{-1}\times 100 \quad (8)$$

$$\text{draft at end of plug (\%)}=(\text{billet diameter}-\text{roll opening at end of plug})\times(\text{billet diameter})^{-1}\times 100 \quad (9)$$

Experiment 1

A billet made from an austenitic stainless steel corresponding to SUS316 and having the chemical composition shown in Table 2 was used as a material for working, and piercing was carried out while varying the P content and pipe expansion ratio (outer diameter of the shell after piercing/billet diameter) as shown in Table 3.

Some of the results are also shown in Table 3.

TABLE 2

| Chemical composition of test billet (mass %) | | | | | | |
|---|---|---|---|---|---|---|
| C | Si | Mn | S | Ni | Cr | Mo |
| 0.08 | 1.00 | 2.00 | 0.005 | 10.00 | 17.00 | 2.80 |

Note:
Remainder is Fe and unavoidable impurities such as P.

Note: Remainder is Fe and unavoidable impurities such as P.

TABLE 3

Results of Experiment 1

| P content [mass %] | Billet diameter [mm] | Outer diameter of shell [mm] | Wall thickness of shell [mm] | Pipe expansion ratio (H) | t/d ratio (%) | Presence of inner surface flaws |
|---|---|---|---|---|---|---|
| 0.030 | 70.0 | 72.0 | 4.4 | 1.03 | 6.1 | Yes (X) |
| 0.030 | 70.0 | 75.0 | 4.8 | 1.07 | 6.4 | Yes (X) |
| 0.030 | 70.0 | 81.0 | 5.0 | 1.16 | 6.2 | Yes (X) |
| 0.030 | 70.0 | 95.0 | 5.5 | 1.36 | 5.8 | Yes (X) |
| 0.030 | 70.0 | 115.0 | 6.5 | 1.64 | 5.7 | Yes (X) |
| 0.020 | 70.0 | 72.0 | 4.5 | 1.03 | 6.3 | Yes (X) |
| 0.020 | 70.0 | 75.0 | 4.8 | 1.07 | 6.4 | Yes (X) |
| 0.020 | 70.0 | 81.0 | 5.0 | 1.16 | 6.2 | Yes (X) |
| 0.020 | 70.0 | 95.0 | 5.5 | 1.36 | 5.8 | No (○) |
| 0.020 | 70.0 | 115.0 | 6.5 | 1.64 | 5.7 | No (○) |
| 0.010 | 70.0 | 72.0 | 4.5 | 1.03 | 6.3 | Yes (X) |
| 0.010 | 70.0 | 75.0 | 4.8 | 1.07 | 6.4 | Yes (X) |
| 0.010 | 70.0 | 81.0 | 5.0 | 1.16 | 6.2 | No (○) |
| 0.010 | 70.0 | 95.0 | 5.5 | 1.36 | 5.8 | No (○) |
| 0.010 | 70.0 | 115.0 | 6.5 | 1.64 | 5.7 | No (○) |

The below-mentioned qualitative tendency can be confirmed from the results shown in Table 3.

Namely, when the P content decreases, inner surface flaws can be prevented even when the pipe expansion ratio is fixed at the same level. In addition, when the P content is fixed at the same level, flaws no longer occur even if the pipe expansion ratio is increased.

Experiment 2

In the same manner as in Experiment 1, a billet made from an austenitic stainless steel corresponding to SUS316 and having the chemical composition shown in Table 2 was used as a material for working, and piercing was performed under the conditions shown in Table 4.

In the same manner as in Experiment 1, the P content of the billet which was used was varied among three levels. However, unlike the case of example 1, in the piercing, the outer diameter of the shell after piercing was made approximately the same, and the pipe expansion ratio was varied by varying the diameter of the billet being worked.

The results are also shown in Table 4.

TABLE 4

Results of Experiment 2

| P content [mass %] | Billet diameter [mm] | Outer diameter of shell [mm] | Wall thickness of shell [mm] | Pipe expansion ratio (H) | t/d ratio (%) | Presence of inner surface flaws |
|---|---|---|---|---|---|---|
| 0.030 | 85.0 | 93.0 | 5.0 | 1.09 | 5.4 | Yes (X) |
| 0.030 | 80.0 | 94.0 | 4.8 | 1.18 | 5.1 | Yes (X) |
| 0.030 | 65.0 | 94.5 | 4.8 | 1.45 | 5.1 | Yes (X) |
| 0.030 | 55.0 | 95.5 | 4.9 | 1.74 | 5.1 | No (○) |
| 0.020 | 85.0 | 93.0 | 5.1 | 1.09 | 5.5 | Yes (X) |
| 0.020 | 80.0 | 94.0 | 4.8 | 1.18 | 5.1 | Yes (X) |
| 0.020 | 65.0 | 94.5 | 4.8 | 1.45 | 5.1 | No (○) |
| 0.020 | 55.0 | 95.5 | 4.8 | 1.74 | 5.0 | No (○) |
| 0.010 | 80.0 | 94.0 | 4.8 | 1.18 | 5.1 | No (○) |
| 0.010 | 65.0 | 94.5 | 4.6 | 1.45 | 4.9 | No (○) |
| 0.010 | 55.0 | 95.5 | 4.8 | 1.74 | 5.0 | No (○) |

The following was learned from the results shown in Table 4.

Namely, when the P content is decreased, the formation of inner surface flaws can be avoided even if the pipe expansion ratio is fixed at the same level, and when the pipe expansion ratio is increased, inner surface flaws no longer occur even if the P content is fixed at the same level.

Experiment 3

A billet made from an austenitic stainless steel corresponding to SUS316 and having the chemical composition shown in Table 2 was used as a material for working, and piercing was carried out while varying the S content and the pipe expansion ratio as shown in Table 5.

The results are shown in Table 5.

TABLE 5

Results of Experiment 3

| S content [mass %] | Billet diameter [mm] | Outer diameter of shell [mm] | Wall thickness of shell [mm] | Pipe expansion ratio (H) | t/d ratio (%) | Presence of inner surface flaws |
|---|---|---|---|---|---|---|
| 0.020 | 70.0 | 75.0 | 4.8 | 1.07 | 6.4 | Yes (X) |
| 0.020 | 70.0 | 81.0 | 5.0 | 1.16 | 6.2 | Yes (X) |
| 0.020 | 70.0 | 95.0 | 5.5 | 1.36 | 5.8 | Yes (X) |
| 0.020 | 70.0 | 115.0 | 6.5 | 1.64 | 5.7 | Yes (X) |
| 0.005 | 70.0 | 75.0 | 4.8 | 1.07 | 6.4 | Yes (X) |
| 0.005 | 70.0 | 81.0 | 5.0 | 1.16 | 6.2 | Yes (X) |
| 0.005 | 70.0 | 95.0 | 5.5 | 1.36 | 5.8 | No (○) |
| 0.005 | 70.0 | 115.0 | 6.5 | 1.64 | 5.7 | No (○) |

The following tendency can be seen from the results shown in Table 5.

Namely, when the S content is decreased, inner surface flaws do not occur even when the pipe expansion ratio is fixed at the same level. In addition, when the pipe expansion ratio is increased, inner surface flaws do not occur even if the S content is fixed at the same level.

By carrying out studies while repeating experiments like those described above, the present inventors were able to derive relational equations concerning the P content and the S content of a billet to be worked and the pipe expansion ratio H during piercing which can obtain a shell which suppresses inner surface flaws and has a low t/d ratio.

The relational equation is shown by the following Equation 10.

$$\left[\frac{P}{0.025\times H-0.01}\right]^2+\left[\frac{S}{0.015\times H-0.01}\right]^2\leq 1 \quad (10)$$

wherein

H=outer diameter of shell (mm)/diameter of billet (mm)

P: P content of shell (mass %)

S: S content of shell (mass %)

FIG. 5 is a graph showing the above-described Equation 10 in three-dimensional form.

As is clear from FIG. 5, the above-described Equation 10 is an equation showing the conical region in FIG. 5. The region in which grain boundary melting can be suppressed is a region corresponding to ¼ of the cone.

Namely, the present inventors carried out the above-described experiments for deriving the coefficients in above-described Equation 10, they plotted the data for which there was no grain boundary melting cracks obtained by experiments in the above-described graph of FIG. 5, and they were able to obtain Equation 10.

FIG. 6 is a graph showing the presence or absence of the occurrence of cracks in relationship between the P content and the pipe expansion ratio H in cross sections (1) and (2) of FIG. 5 in which the S content is constant.

It was confirmed that if a shell obtained by piercing of an austenitic stainless steel billet having a regulated S content and P content under the conditions of Equation 10 is rolled in accordance with the usual manufacturing procedure for a seamless steel pipe to form a pipe, a good quality austenitic stainless steel seamless steel pipe is stably obtained.

The present invention was completed based on the above-described knowledge and is as follows.

(1) A shell for manufacturing a seamless steel pipe of austenitic stainless steel, characterized in that when the wall thickness of the shell after piercing is t and the outer diameter of the shell is d, the ratio t/d is at most 7%, the P content of the steel constituting the shell is at most 0.040 mass % and the S content is at most 0.020 mass %, a piercing history with skewed rolls is such that the pipe expansion ratio H satisfies the following equation, and inner surface flaws are not observed in an as-pierced state.

$$\left[\frac{P}{0.025\times H-0.01}\right]^2+\left[\frac{S}{0.015\times H-0.01}\right]^2\leq 1 \quad \text{[Equation 1]}$$

wherein

H=outer diameter of shell (mm)/diameter of billet (mm)

P: P content of shell (mass %)

S: S content of shell (mass %)

(2) A shell as described above in (1) wherein the austenitic stainless steel contains a total of at least 10 mass % of at least one of Al, Cr, Cu, Mn, Mo, Ni, Nb, Si, Ti, W, V, and Zr.

(3) A shell as described above in (1) or (2) wherein the pipe expansion ratio is at least 1 and at most 2.

(4) A shell as described above in any of (1)-(3) wherein the P content of the steel is at most 0.020 mass % and the S content is at most 0.005 mass %.

(5) A method of manufacturing a shell for manufacturing a seamless steel pipe of an austenitic stainless steel, characterized by performing piercing with skewed rolls on a steel billet having a P content of at most 0.040 mass % and an S content of at most 0.020 mass % under conditions in which the heating temperature of the billet is at least 1200° C., the ratio t/d after piercing (t is the wall thickness of the shell after piercing and d is the outer diameter of the shell) is at most 7%, and the pipe expansion ratio satisfies the following equation, wherein inner surface flaws are not observed in an as-pierced state.

$$\left[\frac{P}{0.025\times H-0.01}\right]^2+\left[\frac{S}{0.015\times H-0.01}\right]^2\leq 1 \qquad \text{[Equation 2]}$$

wherein

H=outer diameter of shell (mm)/diameter of billet (mm)

P: P content of shell (mass %)

S: S content of shell (mass %)

(6) A manufacturing method for a shell as described above in (5) wherein the austenitic stainless steel contains a total of at least 10 mass % of at least one of Al, Cr, Cu, Mn, Mo, Ni, Nb, Si, Ti, W, V, and Zr.

(7) A manufacturing method for a shell as described above in (5) or (6) wherein the pipe expansion ratio is at least 1 and at most 2.

(8) A manufacturing method for a shell as described above in any one of (5)-(7) wherein when piercing with skewed rolls is performed, if the diameter of the billet is $d_b$ (mm), the roll diameter at the roll gorge portion is $D_r$ (mm), and the roll rotational speed is N (rpm), then the peripheral speed of the skewed rolls is in the following range:

$$300\leqq(D_r\times N)/d_b\leqq 500$$

(9) A method of manufacturing a seamless steel pipe of a high alloy steel, characterized by performing pipe rolling of a shell for manufacturing a seamless steel pipe as described above in (1) and then performing sizing.

(10) A method of manufacturing a seamless steel pipe of a high alloy steel, characterized by manufacturing a shell for manufacturing a seamless steel pipe by the manufacturing method described above in (6), then performing pipe rolling of the resulting shell, and then performing sizing.

BRIEF DESCRIPTION OF THE DRAWINGS

FIG. 1 is a simulated phase diagram showing the effect of P on the solidus temperature (melting point) on an austenitic stainless steel (SUS316).

FIG. 2(*a*) is a schematic perspective view of a billet showing the definitions of $x_0$, $y_0$, and $z_0$, and FIG. 2(*b*) is a schematic perspective view of a pierced shell showing the definitions of x, y, and z.

BEST MODE FOR CARRYING OUT THE INVENTION

Figure 3:
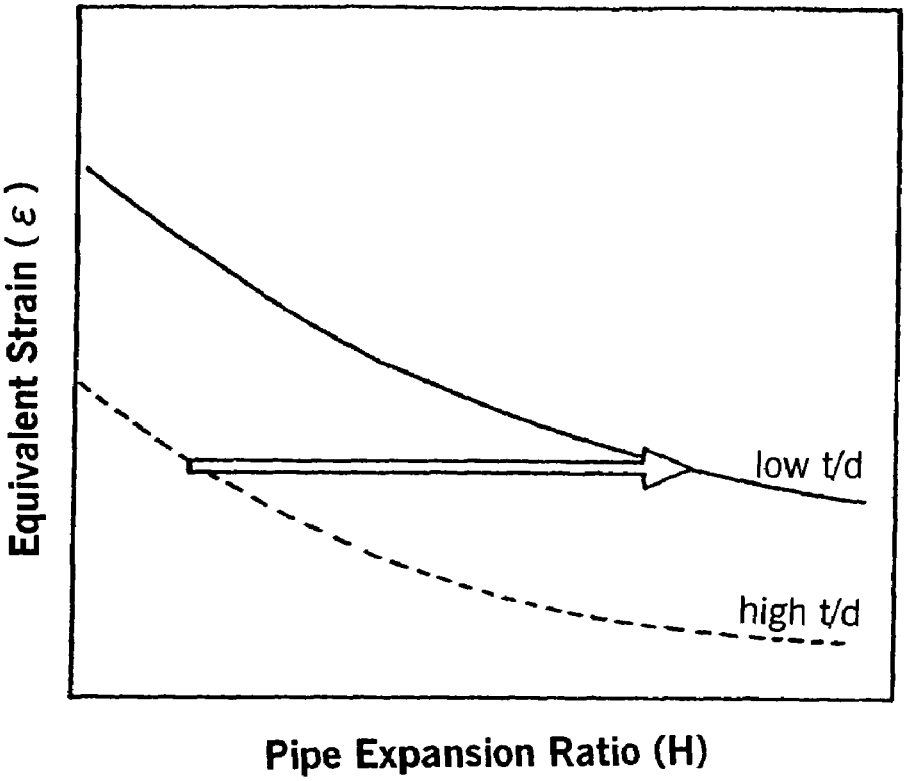
FIG. 3 is a relational view obtained by studies on the effect of the t/d ratio of a material after piercing and the pipe expansion ratio on the equivalent strain applied to a material to be pierced.

An austenitic stainless steel for manufacturing a seamless steel pipe which is the object of the present invention is a steel containing a total of at least 10 mass % of at least one alloying element such as Al, Cr, Cu, Mn, Mo, Ni, Nb, Si, Ti, W, V, and Zr. The type is not particularly restricted, and it may be any austenitic stainless steel, such as SUS316, SUS321, and SUS347. There is no particular limit on the total amount of these elements.

According to the present invention, whatever the type of steel, the P content of the steel is limited to at most 0.040 mass % and the S content is limited to at most 0.020 mass %.

This is because if the P content of the steel exceeds 0.040 mass % or the S content exceeds 0.020 mass %, grain boundary melting occurs at the time of piercing, and it becomes easy for inner surface flaws to develop in the shell, and due to the inner surface flaws, it becomes difficult to stably manufacture a good quality seamless steel pipe. This tendency is particularly marked when a steel billet which is the starting material is heated to a relatively high temperature and piercing is performed to obtain a thin-walled shell with a low t/d ratio.

As described previously, the pipe expansion ratio H during piercing needs to satisfy the conditions prescribed by Equation 10.

When the pipe expansion ratio H does not satisfy the conditions prescribed by Equation 10, a steel shell (and particularly one with a low t/d ratio) with no inner surface flaws cannot be obtained by piercing.

However, if a steel shell having a P content of at most 0.040 mass % and a S content of at most 0.020% and having a piercing history (a piercing history with skewed rolls) such that the pipe expansion ratio H satisfies Equation 10 is subjected to rolling and a seamless steel pipe is manufactured, even if such a shell has a small wall thickness, inner surface flaws caused by grain boundary melting and the like do not occur, so a good quality seamless steel pipe of an austenitic stainless steel can be obtained.

In addition, a shell of the above-described austenitic stainless steel according to the present invention can be rapidly manufactured with good productivity, so the decrease in temperature from the heating temperature is small, and this fact also greatly contributes to the ability to manufacture a good quality seamless steel pipe of an austenitic stainless steel.

When carrying out piercing of a shell for manufacturing a seamless steel pipe according to the present invention, it is of course necessary for the pipe expansion H to satisfy the conditions prescribed by Equation 10, but it is also preferable for the pipe expansion ratio H to be in the range of at least 1.15.

This is because if the pipe expansion ratio H is 1.15 or larger, a tube shell with a t/d ratio of 7% or less can easily be manufactured.

On the other hand, if the pipe expansion ratio exceeds 2, the swelling of the shell becomes too large, it becomes easy for a phenomenon to occur in which the material being treated is forced into the gap between the rolls and a disc or guide shoe which are tools for restricting the outer surface and tearing results, and there is a tendency for this to be a cause of rolling problems.

In a manufacturing method for a shell of an austenitic stainless steel according to the present invention, it is unnecessary to restrict the heating temperature of the billet to be treated to a low level, so in order to smoothly carry out rolling after piercing, piercing is preferably carried out with the billet to be worked heated to at least 1200° C. The preferred range for the billet heating temperature T obtained by experiments is given by the following equation.

$$1200° C. \leqq T \leqq 1290° C.$$

When performing piercing of a shell for manufacturing a seamless steel pipe according to the present invention, when the diameter of the billet being worked is $d_b$ (mm), the roll diameter in the roll gorge portion is $D_r$ (mm), and the roll rotational speed is N (rpm), it was determined by experiment that the peripheral speed of the skewed rolls is preferably in a range which satisfies the following Equation 11.

$$300 \leqq (D_r \times N)/d_b \leqq 500 \quad (11)$$

The fractional equation of Equation 11 of course expresses the preferred range for the roll peripheral speed with the billet diameter being non-dimensionalized so as to be applicable to billets of various diameters.

The preferred ranges for the billet heating temperature and the peripheral speed of the skewed rolls described above are much higher than those for the previously described prior art proposal for piercing of a shell of austenitic stainless steel, and they are not subjected to the restrictions of the manufacturing conditions for ordinary carbon steel and the like.

Next, the present invention will be described by examples.

EXAMPLES

Billets of austenitic stainless steel corresponding to SUS321 or SUS347 and having the chemical compositions shown in Table 6 were heated to 1250° C., piercing was then carried out using a piercer with skewed rolls, and shells having the outer diameter and wall thickness shown in Table 6 were manufactured.

In this case, the roll skew angle, the gorge draft, and the draft at the end of the plug were set to the values shown in Table 1, and the roll peripheral speed was adjusted to be in a range satisfying Equation 11.

| Test | Chemical compositon of billet (mass %) | | | | | | | | Billet diameter | Shell outer diameter | Shell wall thickness | Pipe expansion ratio | t/d ratio | Equation(1) | Inner surface |
|---|---|---|---|---|---|---|---|---|---|---|---|---|---|---|---|
| No. | C | Si | Mn | Ni | Cr | Other | P | S | [mm] | [mm] | [mm] | (H) | (%) | satisfied | flaws |
| 1 | 0.08 | 1.00 | 2.00 | 10.00 | 18.00 | Ti 5 × C % | 0.015 | 0.008 | 85.0 | 93.0 | 5.5 | 1.09 | 5.9 | NO | YES (X) |
| 2 | 0.08 | 1.00 | 2.00 | 10.00 | 18.00 | Ti 5 × C % | 0.015 | 0.008 | 80.0 | 94.0 | 5.5 | 1.18 | 5.9 | NO | YES (X) |
| 3 | 0.08 | 1.00 | 2.00 | 10.00 | 18.00 | Ti 5 × C % | 0.015 | 0.008 | 85.0 | 94.5 | 5.5 | 1.45 | 5.8 | YES | NO (○) |
| 4 | 0.08 | 1.00 | 2.00 | 10.00 | 18.00 | Ti 5 × C % | 0.015 | 0.008 | 55.0 | 95.5 | 5.5 | 1.74 | 5.8 | YES | NO (○) |
| 5 | 0.08 | 1.00 | 2.00 | 10.00 | 18.00 | Ti 5 × C % | 0.015 | 0.016 | 65.0 | 94.5 | 5.5 | 1.45 | 5.8 | NO | YES (X) |
| 6 | 0.08 | 1.00 | 2.00 | 10.00 | 18.00 | Ti 5 × C % | 0.025 | 0.008 | 65.0 | 94.5 | 5.5 | 1.45 | 5.8 | NO | YES (X) |
| 7 | 0.08 | 1.00 | 2.00 | 10.00 | 18.00 | Nb 10 × C % | 0.015 | 0.008 | 70.0 | 75.0 | 4.8 | 1.07 | 6.4 | NO | YES (X) |
| 8 | 0.08 | 1.00 | 2.00 | 10.00 | 18.00 | Nb 10 × C % | 0.015 | 0.008 | 70.0 | 81.0 | 5.0 | 1.16 | 6.2 | NO | YES (X) |
| 9 | 0.08 | 1.00 | 2.00 | 10.00 | 18.00 | Nb 10 × C % | 0.015 | 0.008 | 70.0 | 95.0 | 5.5 | 1.36 | 5.8 | YES | NO (○) |
| 10 | 0.08 | 1.00 | 2.00 | 10.00 | 18.00 | Nb 10 × C % | 0.015 | 0.008 | 70.0 | 115.0 | 6.5 | 1.64 | 5.7 | YES | NO (○) |
| 11 | 0.08 | 1.00 | 2.00 | 10.00 | 18.00 | Nb 10 × C % | 0.020 | 0.010 | 60.0 | 110.0 | 4.5 | 1.83 | 4.1 | YES | NO (○) |
| 12 | 0.08 | 1.00 | 2.00 | 10.00 | 18.00 | Nb 10 × C % | 0.030 | 0.010 | 60.0 | 110.0 | 4.5 | 1.83 | 4.1 | NO | YES (X) |
| 13 | 0.08 | 1.00 | 2.00 | 10.00 | 18.00 | Nb 5 × C % | 0.030 | 0.010 | 60.0 | 110.0 | 4.5 | 1.83 | 4.1 | NO | NO (○) |
| 14 | 0.08 | 1.00 | 2.00 | 10.00 | 18.00 | Nb 10 × C % | 0.030 | 0.010 | 55.0 | 110.0 | 4.5 | 2.00 | 4.1 | YES | NO (○) |
| 15 | 0.08 | 1.00 | 2.00 | 10.00 | 17.00 | Mo 2.1% | 0.020 | 0.014 | 65.0 | 94.5 | 4.5 | 1.45 | 4.8 | NO | YES (X) |
| 16 | 0.08 | 1.00 | 2.00 | 10.00 | 17.00 | Mo 2.1% | 0.020 | 0.014 | 70.0 | 110.0 | 4.5 | 1.57 | 4.1 | NO | YES (X) |
| 17 | 0.08 | 1.00 | 2.00 | 10.00 | 17.00 | Mo 2.1% | 0.020 | 0.014 | 65.0 | 110.0 | 4.5 | 1.69 | 4.1 | NO | YES (X) |
| 18 | 0.08 | 1.00 | 2.00 | 10.00 | 18.00 | Mo 2.1% | 0.020 | 0.014 | 60.0 | 110.0 | 4.5 | 1.83 | 4.1 | YES | NO (○) |
| 19 | 0.08 | 1.00 | 2.00 | 10.00 | 18.00 | Mo 2.1% | 0.020 | 0.014 | 55.0 | 110.0 | 4.5 | 2.00 | 4.1 | YES | NO (○) |
| 20 | 0.08 | 1.00 | 2.00 | 10.00 | 18.00 | Mo 2.1% | 0.012 | 0.014 | 70.0 | 110.0 | 4.5 | 1.57 | 4.1 | NO | YES (X) |
| 21 | 0.08 | 1.00 | 2.00 | 10.00 | 18.00 | Mo 2.1% | 0.012 | 0.014 | 65.0 | 110.0 | 4.5 | 1.69 | 4.1 | NO | YES (X) |
| 22 | 0.08 | 1.00 | 2.00 | 10.00 | 18.00 | Mo 2.1% | 0.012 | 0.014 | 60.0 | 110.0 | 4.5 | 1.83 | 4.1 | YES | NO (○) |
| 23 | 0.08 | 1.00 | 2.00 | 10.00 | 18.00 | Mo 2.2% | 0.012 | 0.014 | 55.0 | 110.0 | 4.5 | 2.00 | 4.1 | YES | NO (○) |
| 24 | 0.08 | 1.00 | 2.00 | 10.00 | 18.00 | Mo 2.1% | 0.012 | 0.018 | 60.0 | 110.0 | 4.5 | 1.83 | 4.1 | NO | YES (X) |
| 25 | 0.08 | 1.00 | 2.00 | 10.00 | 18.00 | Mo 2.1% | 0.012 | 0.018 | 55.0 | 110.0 | 4.5 | 2.00 | 4.1 | YES | NO (○) |

(Note)
Remaining components of billet are Fe and unavoidable impurities.

Figure 4:
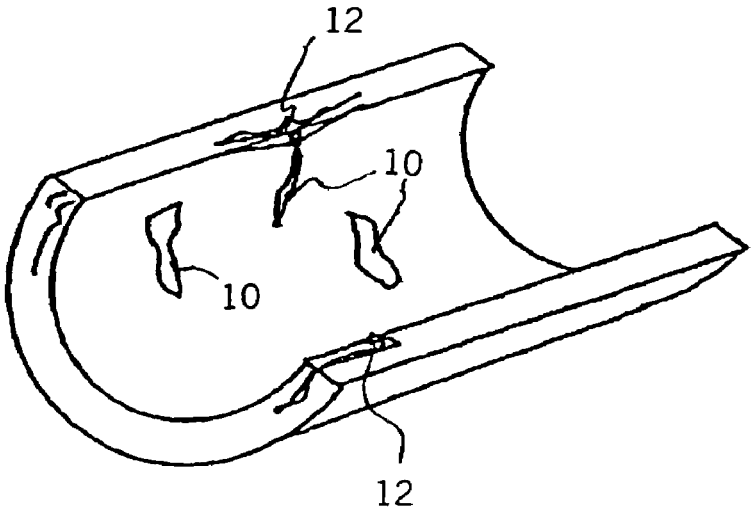
FIG. 4 is a schematic perspective view of a pierced shell which has been longitudinally split showing the form of inner surface flaws (inside scab) caused by grain boundary melting.
Figure 5:
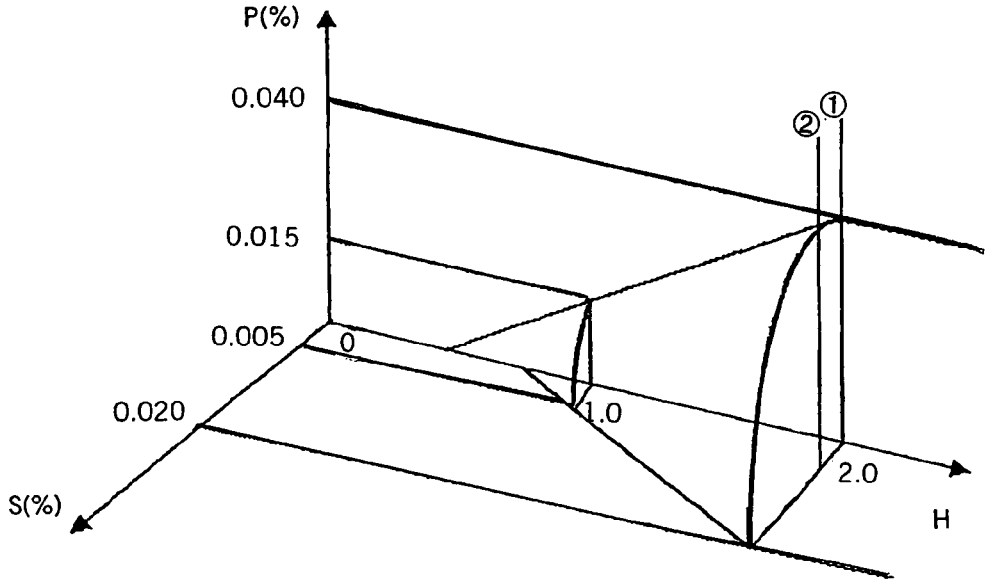
FIG. 5 is a graph showing in three dimensions Equation 10, which is a relational equation of the P content and the S content of a steel billet which can provide a shell which suppresses inner surface flaws and has a low t/d ratio to the pipe expansion ratio H during piercing.
Figure 6:
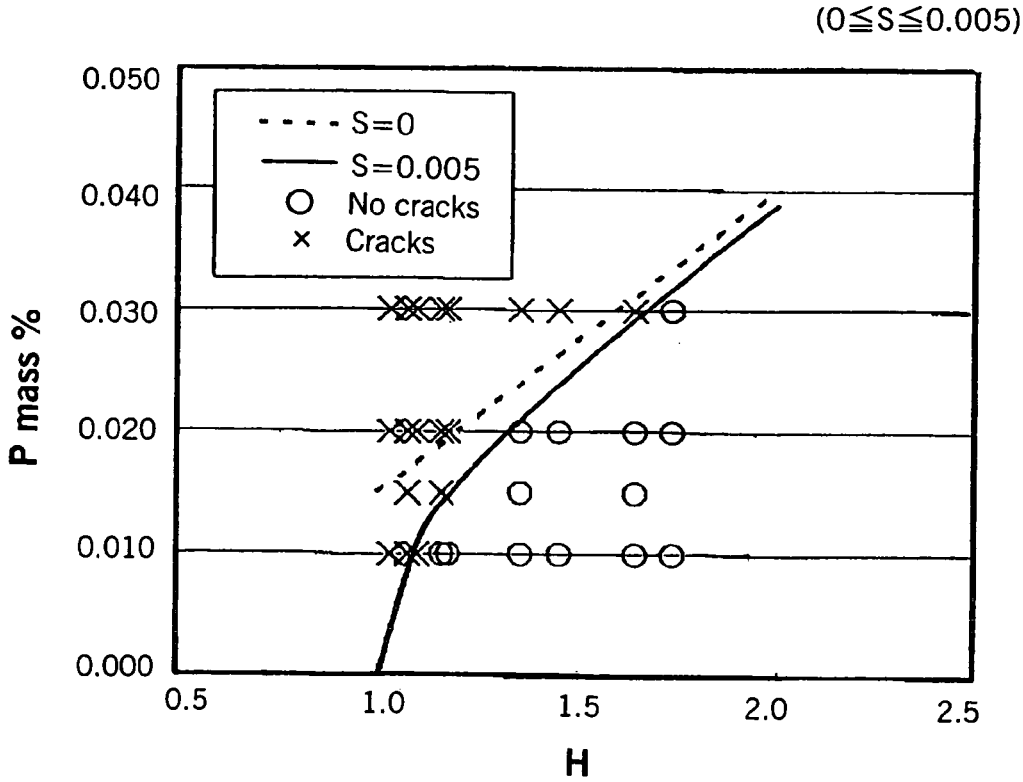
FIG. 6 is a graph showing the presence or absence of the occurrence of cracks in the relationship between the P content and the pipe expansion ratio H in cross sections 1 and 2 of FIG. 5 when the S content is constant.

The resulting shell was cut into rings at a pitch of 300 mm, and then each was split longitudinally as shown in FIG. 4, and it was investigated for the presence or absence of inner surface flaws by splitting in two (inner surface flaws in which portions a few mm inwards from the inner surface are split in two due to grain boundary melting).

The results of this investigation are shown in Table 6.

As can be seen from the results of Table 6, there were no inner surface flaws observed in shells made from an austenitic stainless steel obtained by piercing according to the present invention, whereas inner surface flaws occurred in shells which did not satisfy the conditions of Equation 10.

From a comparison of the results of Test Nos. 11, 12, and 13, it can be seen that, as already stated, lowering the P content is comparable to lowering the content of metallic elements which form low melting point compounds (Nb in this case) and is effective at preventing inner surface flaws.

Next, when the shell obtained in Test Nos. 3, 4, and 9-11 were immediately elongated in a subsequent mandrel mill and then sized in a sizing mill to form a seamless steel pipe, in each case, manufacture could be completed without any problems, and it can be seen that a good condition could be maintained on the inner surface and the outer surface of the resulting seamless steel pipe of an austenitic stainless steel.

The shells which were subjected to these manufacturing operations had a high billet heating temperature of 1250° C., so in each case, a relatively high temperature (1100-1150° C.) was maintained even when they became a pierced shell, and therefore the subsequent elongation in the elongator was carried out extremely smoothly.

In these examples, examples of piercing and pipe manufacture were described with respect to steels corresponding to SUS321 or SUS347, but it has been confirmed that good results are obtained by following the conditions prescribed by the present invention even when other austenitic stainless steels are used as a material for working.

INDUSTRIAL APPLICABILITY

According to the present invention, extremely useful industrial effects are obtained such as that even when the outer diameter/wall thickness ratio (t/d ratio) after piercing is at most 7%, a pierced shell of an austenitic stainless steel guaranteeing a good condition of its inner surface can be provided without problems such as an lengthening of the time required for piercing, a decrease in the lifespan of tools, and a decrease in the temperature of the shell, and that a stable manufacturing method for a good quality seamless steel pipe of austenitic stainless steel using this shell can be provided.

What is claimed is:

1. A tube shell for manufacturing a seamless steel pipe of austenitic stainless steel, characterized in that the P content of the steel constituting the shell is at most 0.040 mass % and the S content is at most 0.020 mass %, and the shell is pierced with skewed rolls under conditions that the pipe expansion ratio H satisfies the following equation.

$$\left[\frac{P}{0.025\times H-0.01}\right]^2+\left[\frac{S}{0.015\times H-0.01}\right]^2\leq 1 \qquad \text{[Equation 1]}$$

wherein

H=outer diameter of shell (mm)/diameter of billet (mm)

P: P content of shell (mass %)

S: S content of shell (mass %).

2. A tube shell as claimed in claim 1 wherein the austenitic stainless steel contains a total of at least 10 mass % of at least one of Al, Cr, Cu, Mn, Mo, Ni, Nb, Si, Ti, W, V, and Zr.

3. A tube shell as claimed in claim 1 wherein the pipe expansion ratio is at least 1.15.

4. A tube shell as claimed in claim 1 wherein the P content of the steel is at most 0.020 mass % and the S content is at most 0.005 mass %.

5. A tube shell as claimed in claim 1 wherein the ratio of t/d is at most 7% in which "t" is the wall thickness of the shell after piercing and "d" is the outer diameter of the shell after piercing.

6. A method of manufacturing a seamless steel pipe of a high alloy steel, characterized by performing piercing of a tube shell for manufacturing a seamless steel pipe as claimed in claim 1 and then performing sizing.

7. A tube shell as claimed in claim 2 wherein the pipe expansion ratio is at least 1.15.

8. A tube shell as claimed in claim 2 wherein the P content of the steel is at most 0.020 mass % and the S content is at most 0.005 mass %.

9. A tube shell as claimed in claim 3 wherein the P content of the steel is at most 0.020 mass % and the S content is at most 0.005 mass %.

10. A tube shell as claimed in claim 2 wherein the ratio of t/d is at most 7% in which "t" is the wall thickness of the shell after piercing and "d" is the outer diameter of the shell after piercing.

11. A tube shell as claimed in claim 3 wherein the ratio of t/d is at most 7% in which "t" is the wall thickness of the shell after piercing and "d" is the outer diameter of the shell after piercing.

12. A tube shell as claimed in claim 4 wherein the ratio of t/d is at most 7% in which "t" is the wall thickness of the shell after piercing and "d" is the outer diameter of the shell after piercing.

13. A tube shell as claimed in claim 1, wherein the tube shell is pierced with skewed rolls from a billet which has been heated to at least 1200° C.

14. A method of manufacturing a tube shell for manufacturing a seamless steel pipe of an austenitic stainless steel, characterized by performing piercing with skewed rolls on a steel billet having a P content of at most 0.040 mass % and an S content of at most 0.020 mass % under conditions in which the pipe expansion ratio satisfies the following equation:

$$\left[\frac{P}{0.025\times H-0.01}\right]^2+\left[\frac{S}{0.015\times H-0.01}\right]^2\leq 1 \qquad \text{[Equation 2]}$$

wherein

H=outer diameter of shell (mm)/diameter of billet (mm)

P: P content of shell (mass %)

S: S content of shell (mass %).

15. A manufacturing method for a tube shell as claimed in claim 14 wherein the austenitic stainless steel contains a total of at least 10 mass % of at least one of Al, Cr, Cu, Mn, Mo, Ni, Nb, Si, Ti, W, V, and Zr.

16. A manufacturing method for a tube shell as claimed in claim 14 wherein the pipe expansion ratio is at least 1.15.

17. A manufacturing method for a tube shell as claimed in claim 14 wherein the piercing with skewed rolls is performed under conditions in which the heating temperature of the billet is at least 1200° C. and the ratio t/d after piercing (t is the wall thickness of the shell after piercing and d is the outer diameter of the shell) is at most 7%.

18. A manufacturing method for a tube shell as claimed in claim 14 wherein when piercing with skewed rolls is performed, if the diameter of the billet is $d_b$ (mm), the roll diameter at the roll gorge portion is $D_r$ (mm), and the roll rotational speed is N (rpm), then the peripheral speed of the skewed rolls is in the following range:

$$300\leqq(D_r\times N)/d_b\leqq 500.$$

19. A method of manufacturing a seamless steel pipe of a high alloy steel, characterized by manufacturing a tube shell for manufacturing a seamless steel pipe by the manufacturing method claimed in claim 6, then performing pipe rolling of the resulting shell, and then performing sizing.

20. A manufacturing method for a tube shell as claimed in claim 15 wherein the pipe expansion ratio is at least 1.15.

21. A manufacturing method for a tube shell as claimed in claim 15 wherein the piercing with skewed rolls is performed under conditions in which the heating temperature of the billet is at least 1200° C. and the ratio t/d after piercing (t is the wall thickness of the shell after piercing and d is the outer diameter of the shell) is at most 7%.

22. A manufacturing method for a tube shell as claimed in claim 15 wherein when piercing with skewed rolls is performed, if the diameter of the billet is $d_b$ (mm), the roll diameter at the roll gorge portion is $D_r$ (mm), and the roll rotational speed is N (rpm), then the peripheral speed of the skewed rolls is in the following range:

$$300 \leqq (D_r \times N)/d_b \leqq 500.$$

23. A manufacturing method for a tube shell as claimed in claim 16 wherein when piercing with skewed rolls is performed, if the diameter of the billet is $d_b$ (mm), the roll diameter at the roll gorge portion is $D_r$ (mm), and the roll rotational speed is N (rpm), then the peripheral speed of the skewed rolls is in the following range:

$$300 \leqq (D_r \times N)/d_b \leqq 500.$$

24. A manufacturing method for a tube shell as claimed in claim 17 wherein when piercing with skewed rolls is performed, if the diameter of the billet is $d_b$ (mm), the roll diameter at the roll gorge portion is $D_r$ (mm), and the roll rotational speed is N (rpm), then the peripheral speed of the skewed rolls is in the following range:

$$300 \leqq (D_r \times N)/d_b \leqq 500.$$

25. A manufacturing method for a tube shell as claimed in claim 14, wherein the piercing with skewed rolls is performed under conditions in which the heating temperature of the billet is at least 1200° C.

* * * * *